United States Patent [19]

Forte

[11] Patent Number: 4,781,820

[45] **Date of Patent: * Nov. 1, 1988**

[54] AROMATIC EXTRACTION PROCESS USING MIXED POLYALKYLENE GLYCOLS/GLYCOL ETHER SOLVENTS

[75] Inventor: Paulino Forte, Yonkers, N.Y.

[73] Assignee: Union Carbide Corporation, Danbury, Conn.

[ * ] Notice: The portion of the term of this patent subsequent to Feb. 12, 2002 has been disclaimed.

[21] Appl. No.: 883,754

[22] Filed: Jul. 9, 1986

Related U.S. Application Data

[63] Continuation of Ser. No. 752,025, Jul. 5, 1985, abandoned.

[51] Int. Cl.[4] ..... C10G 21/16; C07C 7/10

[52] U.S. Cl. ..... 208/333; 208/321; 208/334; 585/804; 585/868

[58] Field of Search ..... 208/322, 323, 321, 324, 208/333, 334, 311; 585/804, 868

[56] References Cited

U.S. PATENT DOCUMENTS

| | | | |
|---|---|---|---|
| 1,908,018 | 5/1933 | Henderson | 196/13 |
| 2,246,297 | 6/1941 | Duncan et al. | 196/13 |
| 2,261,287 | 11/1941 | Read | 196/13 |
| 2,400,802 | 5/1946 | Arnold | 196/13 |
| 2,698,831 | 1/1955 | Teykl | 202/39.5 |
| 2,754,249 | 7/1956 | Meyers et al. | 196/14.15 |
| 2,773,005 | 12/1956 | Meyer et al. | 208/324 X |
| 2,902,428 | 9/1959 | Kimberlin, Jr. et al. | 208/87 |
| 3,291,728 | 12/1966 | Boyum et al. | 208/321 |
| 3,470,089 | 6/1967 | Morris et al. | 208/326 |
| 3,560,375 | 2/1971 | Gelbein | 208/324 |
| 3,779,904 | 12/1973 | Kubek et al. | 208/333 |
| 3,788,980 | 1/1974 | Kubek et al. | 208/333 |
| 3,883,420 | 5/1975 | Stone | 208/321 |
| 4,081,355 | 3/1978 | Preusser et al. | 208/313 |
| 4,168,226 | 9/1979 | White et al. | 208/321 |
| 4,179,362 | 12/1979 | Irani et al. | 202/321 |
| 4,498,980 | 2/1985 | Forte et al. | 208/321 |

FOREIGN PATENT DOCUMENTS 865698 4/1961 United Kingdom .

*Primary Examiner*—Glenn Caldarola
*Attorney, Agent, or Firm*—Morris N. Reinisch

[57] ABSTRACT

This invention relates to an improved more energy efficient process for the separation of aromatic and non-aromatic hydrocarbons from a mixed carbon feed which comprises the following steps:

(a) contacting said feed in an extraction zone with an extraction solvent to provide an aromatic-rich solvent phase and a raffinate phase;
(b) cooling said aromatic-rich solvent and raffinate phases;
(c) introducing said cooled aromatic-rich solvent phase to a separation zone containing aromatic hydrocarbons and a solvent-rich phase containing mixed extraction solvent and water;
(d) introducing said cooled raffinate phase to a separation zone in the presence of water as based on the total weight of water and the raffinate phase to provide a raffinate phase containing non-aromatic hydrocarbons and a solvent/water phase;
(e) adjusting the water present in the solvent-rich phase of step (c) and the solvent/water phase of step (d);
(f) recycling at least or portion the phases in step (e) to step (a);
(g) separately contacting the raffinate of step (d) and the extract of step (c) with water to form two water phases and a raffinate product and an extract product;
(h) combining the water phases of step (g);
(i) recycling at least a portion of the combined water phase of step (h) to step (d).

28 Claims, 2 Drawing Sheets

AROMATIC EXTRACTION PROCESS USING MIXED POLYALKYLENE GLYCOLS/GLYCOL ETHER SOLVENTS

This application is a continuation of prior U.S. application Ser. No. 752,025, filing date 7/5/85, abandoned.

FIELD OF THE INVENTION

The invention relates to an improved, more energy efficient process for the separation of aromatic and nonaromatic hydrocarbons from a mixed hydrocarbon feed, and more particularly, to the separation of aromatic and nonaromatic hydrocarbons in high yields from a mixed aromatic, naphthenic and paraffinic hydrocarbon feed. The instant process significantly decreases the energy requirements necesssary for the separation of aromatic and nonaromatic hydrocarbons and especially well suited for separation of lube oil fractions.

BACKGROUND

The separation of aromatic and nonaromatic hydrocarbons (generally referred to as dearomatization) from mixed hydrocarbon feeds has long been recognized as necessary and advantageous for a number of varied reasons. For example, when a BTX fraction (benzene, toluene and xylene) is the aromatic fraction it may be used as a raw material in the manufacture of petrochemicals, or as an additive for gasoline to increase its octane rating. Further, the nonaromatic fraction derived from these mixed feeds have varied uses as fuels, solvents and the like and, therefore, are also highly desirable. Such uses for the aromatic and nonaromatic fractions have resulted in the development of numerous dearomatization processes.

Of particular interest and difficulty is the separation of the complex components present in lube oils, wherein the removal of aromatic-type hydrocarbons is necessary to improve the viscosity index, thermal and oxidation stability, and color of the lube oils. The presence of aromatic-type hydrocarbons in lube oils affects the quality of these oils due to the low viscosity index, poor thermal and oxidation stability, high carbon residue, and poor color of such aromatic-type hydrocarbons. The aromatic-type hydrocarbons present in lube oils differ significantly from the BTX fraction found in light hydrocarbon mixtures used in the production of gasoline and, as a result, present vastly different separation problems.

Various processes have been suggested for the separation of the aromatic and nonaromatic hydrocarbons of a mixed feed wherein the aromatic is a BTX fraction. Typical of these processes is a process employing an extraction column for separation of a BTX fraction wherein a selective solvent, BTX and a reflux stream is introduced to a two step distillation column. BTX is then distilled to remove water and entrained solvent. Similarly, a process has been suggested wherein two distillation columns are employed with the BTX fraction and water being distilled in the second column. In addition, a process using two distillation columns wherein the second column is employed to distill the BTX fraction and other components, has been suggested.

One goal of the prior art has related to processes developing a dearomatization process which lowers the cost of dearomatization of the mixed hydrocarbon feed. This reduction in cost for dearomatization can be achieved by improving the selectivity of the selective solvent and by modification of the separation process scheme. U.S. Pat. No. 3,985,644 mentions one such method for modifying the process scheme and reducing dearomatization costs, i.e., by reducing the use of energy-intensive steps, e.g., distillation.

The dearomatization of lube oils is of particular interest. Dearomatized lubricating oils are, generally speaking, naphthenic- and or paraffinic-type viscous materials having a low rate of viscosity change with change in temperature, i.e., relatively high viscosity index, a high degree of thermal and oxidation stability, low carbon-forming tendency, good color, and high flash points. Lubricating oil feedstocks are generally recovered as distillates or bottoms from the vacuum distillation of crude oils. A crude lube oil fraction contains many different chemical components, e.g., paraffins, naphthenes, aromatics, and the like. In order to obtain refined lubricating oils of relatively good quality and high viscosity index, the practice has been to remove components, such as aromatic and polyaromatic compounds, which tend to lower the viscosity index of the lube oil. The removal of these aromatic components has heretofore been carried out by processes as above-described and processes such as disclosed in U.S. Pat. Nos. 2,079,885; 2,342,205; 3,600,302; 2,773,005; 3,291,728; 3,788,980; and 3,883,420.

In copending application U.S. Ser. No. 164,039, filed June 30, 1980, commonly assigned, a solvvent extraction-solvent decantation process is disclosed wherein solvent purification with mixed hydrocarbon feed or raffinate can be employed.

In copending application U.S. Ser. No. 267,427, filed June 4, 1981, commonly assigned, there is disclosed a process for the separation of aromatic and nonaromatic containing feedstocks by use of a unique extraction-decantation process wherein the extraction solvent is preferably a low molecular weight polyalkylene glycol. The instant process provides for an improved process by use of improved mixed extraction solvents.

The process of this invention is to be distinguished from the above described processes in that the instant process provides an energy balanced extraction-separation process that is more economically advantageous, i.e., energy efficient than the above-described processes.

SUMMARY OF THE INVENTION

The instant process comprises the separation of a mixed hydrocarbon feed (containing aromatic and nonaromatic components and referred to herein as "feed") with low energy consumption in a continuous solvent extraction-solvent separation process and comprises the following steps:

(a) contacting the hydrocarbon feed with a mixed extraction solvent in an extraction zone, at a temperature of at least about 150° C. to provide a solvent phase and a raffinate phase;

(b) cooling the solvent and raffinate phases;

(c) introducing said cooled solvent phase to a separation zone and introducing therewith about 0.1 to about 25.0 percent by weight of an anti-solvent for said aromatic hydrocarbons in said solvent phase to provide an extract phase containing aromatic hydrocarbons and a solvent-rich phase containing mixed extraction solvent and anti-solvent;

(d) introducing said cooled raffinate phase to a separation zone and introducing therewith about 0.5 to about 75.0 percent by weight of an anti-solvent for said aromatic selective solvent in said raffinate phase to provide a raffinate phase and a solvent/anti-solvent phase;

(e) removing anti-solvent from said solvent-rich phases of steps (c) and (d) and recycling said solvent-rich phase to the extraction zone of step (a); and (f) recovering the extract phase of step (c) and the raffinate of step (d).

Small amounts of entrained and/or or dissolved solvent may be removed from the solvent/solvent containing raffinate and aromatic extract phases by means of water wash processes.

DESCRIPTION OF THE INVENTION

Figure 1:
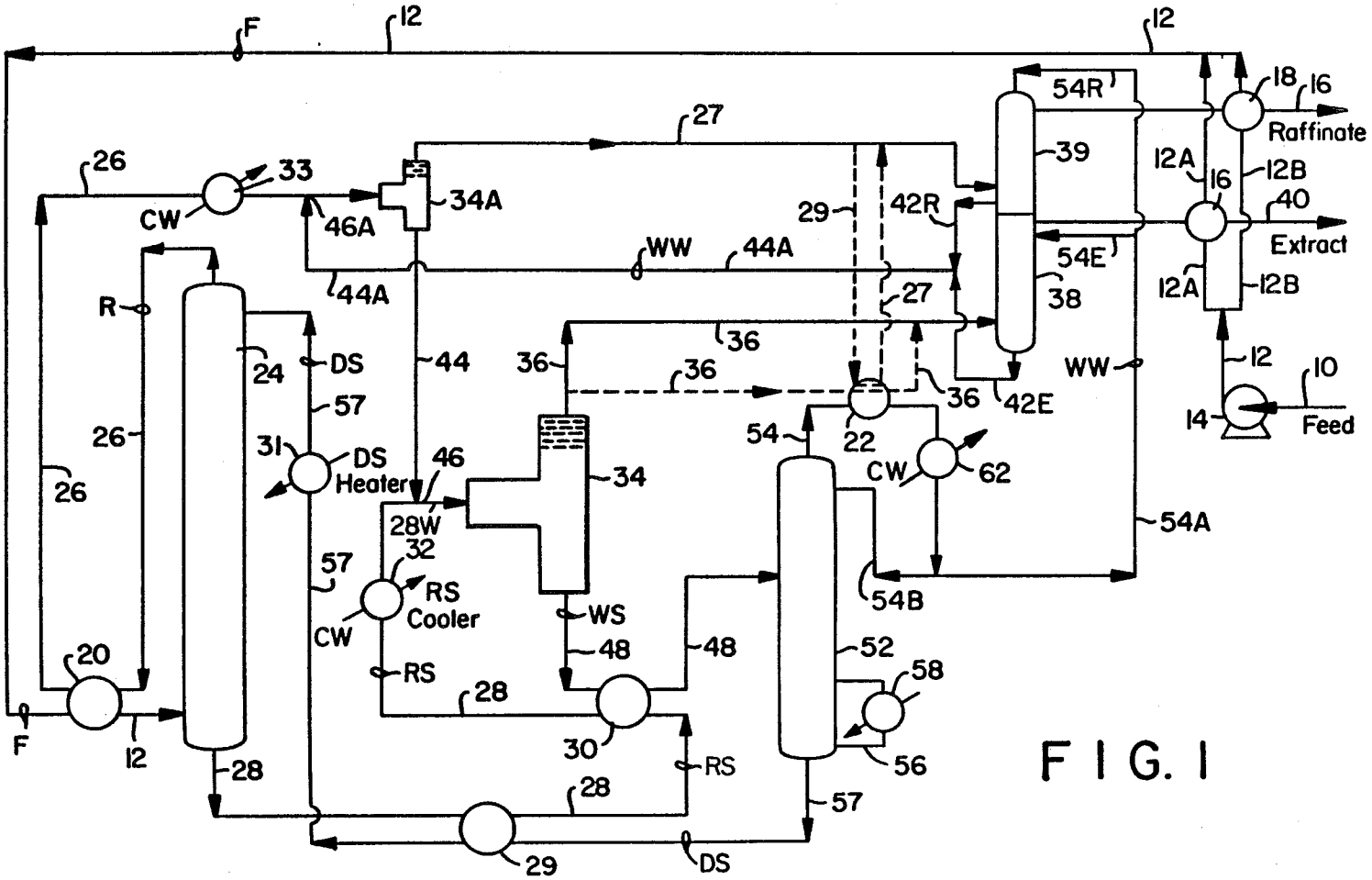
FIG. 1 is a schematic flow disgram of the process of the invention.

There has historically been and continues to be an industrial need for an energy efficient process for the separation of aromatic and nonaromatic hydrocarbons present in mixed hydrocarbon feeds. Naphthas, heating oils, light oils, cracked gasolines, dripolenes, lubricating oils (light distillates to heavy distillates) kerosene and the like, can contain up to 90 percent by weight aromatic-type hydrocarbons, e.g., BTX or polyaromatics. The separation of aromatic and nonaromatic hydrocarbons is of particular interest in the dearomatization of crude lube oils. The components which make up these hydrocarbon feed streams are well known in the art and they will not be extensively discussed herein except to note that the mixed hydrocarbon feed employed herein may be any petroleum of the common distillation fractions containing one or more aromatics components including: naphthas (virgin or cracked); kerosene; gasoline; heating oils; lubricating oils; (light distillates heavy distillates, bright stock and residual oils); jet fuels; and recycle oils. Preferably, the feed stream is a lube oil fraction such as a light distillates to heavy distillate, bright stock, etc., which have boiling points between about 400° F. and about 1100° F.

The aromatic hydrocarbons present in heavy hydrocarbon feeds, e.g., lubricating oils, generally include: alkylbenzenes, indanes, tetralins, indenes, naphthalenes, fluorenes, acenaphthalenes, biphenyls, phenanltrenes, anthracenes, diacenaphthalenes, pyrenes, chripenes, diaceanthrancenes, benzpyrenes and other various aromatic feed components.

The instant process provides for significantly improved processing of feedstocks containing aromatic and nonaromatic components. The instant process provides for an energy efficient separation of aromatic and non-aromatic feed components. The process makes use of special extraction solvents and of separation and decantation steps for both the aromatic (extract) and nonaromatic (raffinate) components of the mixed hydrocarbon feed. The instant process may be employed for treating different feedstocks, e.g., from light paraffin distillate to bright stock, without significantly increasing the energy requirements of the process. This results in savings, in terms of the energy consumption of the process, of up to 50 percent or more, based on the energy required in furfural or similar processes presently employed in the field of such separations. For example, furfural refining is disclosed in "Hydrocarbon Processing", p. 188, September 1978, to involve economics wherein treatment of 7000 bbl/day of a light oil feed would require over 73 million BTU/hour. The instant process would require less than 40 million BTU/hr. to treat such a feed. This significant energy savings is commercially important.

The solvents and cosolvents employed in the instant process may be any of water-miscible organic liquids (at process temperatures) having a boiling point and decomposition temperature higher than the extraction temperature and having selectivity for aromatic compounds. The term "water-miscible" describes those solvents and cosolvents which are completely miscible with water over a wide range of temperatures and which have a high partial miscibility with water at room temperature, since the latter are usually completely miscible at process temperatures.

The preferred solvents are the low molecular weight polyalkylene glycols of the formula:

$$HO—[CHR_1—(CR_2R_3)_n—O]_m—H$$

wherein n is a integer from 1 to 5 and is preferably the integer 1 or 2; m is an integer having a value of 1 or greater, preferably between about 2 to about 20 and most preferably between about 3 and about 8; and wherein $R_1$, $R_2$ and $R_3$ may be hydrogen, alkyl, aryl, araalkyl or alkylaryl and are preferably hydrogen and alkyl having between 1 and about 10 carbon atoms and most preferably are hydrogen. Examples of the polyalkylene glycol solvents employable herein are diethylene glycol, triethylene glycol, tetraethylene glycol, 1,3-butylene glycol, 1,2-butylene glycol, 1,5-pentaethylene glycol, and mixtures thereof and the like. In addition to the polyalkylene glycol solvents, the solvent may be selected from the group consisting of sulfolane, furfural, n-methyl-2-pyrrolidone. Preferred solvents are diethylene glycol, triethylene glycol, tetraethylene glycol, or mixtures thereof with tetraethylene glycol being most preferred. The preferred solvents for use in the instant process are "mixed extraction solvents" wherein one or more of the aforementioned solvents, preferably one or more of the low molecular weight polyalkylene glycols, is employed with a "cosolvent" component, as hereinafter discussed and a disclosed in U.S. Pat. No. 4,498,980. When a "cosolvent" component is employed herein such is preferably a glycol ether of the formula:

$$R_4O—[CH_5—(CHR_6—)—_xO]_y—R_7$$

wherein $R_4$, $R_5$, $R_6$ and $R_7$ may be hydrogen alkyl, aryl, aralkyl, alkylaryl and mixtures thereof with the proviso that $R_4$ or $R_7$ are not both hydrogen. The value of x is an integer from 1 to 5, preferably 1 or 2 and y may be an integer from 1 to 10 and is preferably from 2 to 7, and most preferably from 2 to 5. $R_4$, $R_5$, $R_6$ and $R_7$ are preferably selected from the group consisting of hydrogen and alkyl having 1 to about 10 carbons with the proviso that $R_4$ and $R_7$ may not both be hydrogen and most preferably $R_4$ is alkyl having from 1 to 5 carbons and $R_5$, $R_6$ and $R_7$ are hydrogen. The mixture(s) of solvent and cosolvent is selected such that at least one solvent and one cosolvent are provided to form the mixed extraction solvent. The cosolvent generally comprises between zero (0) and about 99 percent of the mixed extraction solvent, preferably between about 0.5 and about 80 percent and more preferably between about 10 and about 60 percent by weight based on the total weight of the mixed extraction solvent.

An effective amount of an anti-solvent may be employed to modify the capacity and/or selectivity of the solvent in the individual separation steps of the two phases (extract and raffinate) obtained from extraction zone and such may be most any compound that tends to decrease the solubility of the aromatic and non-aromatic hydrocarbons in the extraction solvent. Water is the preferred anti-solvent. The use of water as an anti-solvent in the extraction step has been observed to provide added process versatility by correlating the selected feed with the extraction solvent and the effective amount of anti-solvent present in the extraction zone. Other suitable anti-solvents are believed to include ethylene glycol, glycerine, low molecular weight alcohols and the like. The use of low molecular weight alcohols, even at the low concentration of antisolvent employed, is not generally preferred owing to the art recognized problems associated with the use of alcohols. The effective concentration of the anti-solvent as determined in the extract separation zone is that amount which effectively decreases the solubility of the aromatic hydrocarbon in the extraction solvent as determined by the amount of aromatic hydrocarbon in the extraction solvent leaving the separation zone. The concentration of aromatic hydrocarbons in the extraction solvent leaving the extract separation zone or the amount of solvent in the raffinate leaving the raffinate separation zone is preferably less than 3 percent by weight, based on the weight of the extraction solvent in the aromatic extract or the weight of solvent in the raffinate and is preferably preferably less than 2 percent by weight and more preferably less than 1 percent by weight. The anti-solvent employed in the instant process promotes the formation of two phases to a degree greater than that obtainable by simple cooling of the phases obtained by extraction. The aforementioned cooling and addition of anti-solvent results in the formation of an aromatic-rich extract phase, a raffinate phase and two solvent-rich phases. Generally the concentration of the anti-solvent present in the extract separation zone is in the range of from about 0.5 to 25.0 percent by weight or higher, based on the total weight of the aromatic-rich solvent phase, with the range from about 0.5 to about 15.0 percent being preferred and the range from about 3.0 to about 10.0 being most preferred. The concentration of the anti-solvent present in the raffinate separation zone is in the range of from about 0.5 and about 75 percent by weight, preferably from about 1.0 to about 50 percent by weight and more preferably from about 1.0 to about 40 percent by weight, based on the total weight of the raffinate and anti-solvent in the raffinate separation zone. Some portion of the anti-solvent present in the separation zones (extract and raffinate) may be provided by anti-solvent which may be present in the solvent phase employed in the extraction zone as a result of amounts present in the solvent due to the recycle of the extraction solvent and anti-solvent. As hereinbefore noted, the presence of up to about 10 percent by weight (based on the total weight of the recycled extraction solvent to the extraction zone) may be advantageous in correlating the selectivity and/or capacity of the extraction solvent to changes in the feedstock composition. The actual concentration of the anti-solvent in the separation zones will depend at least in part on the nature of the hydrocarbon feed, nature and relative amount of aromatics present in the hydrocarbon feed, the extraction solvent employed, the anti-solvent employed and the like. The aforementioned concentrations designate the total anit-solvent, e.g. water, present in the separation zone irrespective of its source. Anti-solvent is preferably added to the raffinate and aromatic-rich solvent phases prior to the respective separation zone so as to provide for improved separation in the respective separation zones. In addition, cooling of the raffinate and separation of some extraction solvent prior to the addition of anti-solvent may be advantageous, e.g., more efficient, in some instances in providing for the separation of solvent from the raffinate.

Generally, to accomplish the extraction, the ratio of the extraction solvent to hydrocarbon feed in the extractor zone is in the range from about 2 to about 20 parts by volume of solvent to one part by volume of feed, the ratio from about 2 to 1 to about 15 to 1 being preferred and the ratio from about 4 to 1 to about 10 to 1 being the most preferred. The broad range for the ratio of the solvent to hydrocarbon may be expanded upon depending on the solvent, co-solvent, if any, weight percent of solvent to cosolvent, the weight percent of anti-solvent in the mixed extraction solvent and the like. The optimum solvent to feed ratio also depends upon whether high recovery (yield) or high purity (quality) is desired, although the instant process will generally result in both high recovery and high purity.

In one embodiment of the instant invention it has been observed that by using a solvent and a cosolvent as a "mixed extraction solvent" that the process has a high selectivity and capacity for aromatic hydrocarbons and, further, provides a process wherein the heat duty for the process (the energy consumption of the process) is proportional to the rate at which the feed is introduced and not strictly dependent on the ratio of the solvent to feed. Thus, the instant process provides for the use of similar energy requirements for vastly different feedstocks. This important feature is not found in processes wherein furfural, N-methyl-2-pyrrolidone and phenol have been employed as the extraction solvent in processes not according to the instant invention.

The instant process is further characterized in that the pressure at the top of the extraction zone is typically less than about 150 psig and often less than about 100 psig. This is highly advantageous in terms of ease of operation and the capital expenditure required for carrying out the separation process. The actual pressures in the extraction zone may be higher or lower depending on the particular hydrocarbon feed treated, the extraction solvent employed, the selected antisolvent and its concentration, and the selected temperature at which the extraction is carried out. The pressure employed in the separation zones is generally that pressure which is required to cause the aromatic-rich solvent phase or raffinate phase to pass through the separation zone, although higher pressures may be employed if desired. Generally a small pressure drop (pressure gradient) is observed across the separation zones.

The temperature of the extraction zone is generally at least about 150° C. and is generally in the range of from about 150° C. to about 275° C., preferably in the range of from about 170° C. to about 250° C. and most preferably from about 200° C. to about 240° C. The temperature in the extraction zone is not constant throughout and there will generally be a temperature gradient up to about 30° C. or more, typically from 15° C. to 30° C., as between the temperature of the mixed extraction solvent introduced to the extraction zone and the temperature of the solvent phase leaving the extraction zone.

The separation zones are generally maintained at temperatures in the range of from about 50° C. to about 200° C. below the temperature of the extraction zone such that the temperature is preferably in the range of from about 25° C. to about 150° C., more preferably about 25° C. to about 100° C. and most preferably from about 25° C. to about 70° C. The temperature employed in the separation zones depends, in part, upon solubility of the aromatic hydrocarbon and raffinate in the mixed extraction solvent, the amount of anti-solvent present in the separation zones and the viscosity of the extraction solvent at the temperature(s) employed in the separation zones.

The apparatus employed in the instant process in the extraction zone, separation zones and otherwise are of conventional design. For example, an extraction column of the multistage reciprocating type containing a plurality of perforated plates centrally mounted on a vertical shaft driven by a motor in an oscillatory manner can be used as may columns containing pumps with settling zones or sieve trays with upcomers or downcomers, (Counter-current flow is generally utilized in the extraction column.) The separations in the separation zones can be conducted in a tank with no internal elements but preferably the tank contains coalescing elements or baffles to aid in the separation. The preferred separation zone comprises a coalescer with a porous media having a depth-type coalescing element (fibrous bed coalescer element). It is understood that the "separation zone" is a zone wherein phase separation is facilitated and wherein anti-solvent is present. As noted hereinabove, the anti-solvent is preferably added prior to the separation zones after the solvent phase or reaffinate phase exit the extraction zone and has been at least partially cooled.

Heat exchanges, reservoirs, and solvent regenerators, if necessary, are also of conventional design as well as are the various extractors and decanters used in the various embodiments hereinafter described. The extractors employed are preferably multi-stage counter-current extractors, but can be any of the well-known types, as aforementioned.

The instant process generally provides for an overall recovery of the aromatic hydrocarbon of from about 70 to about 95 percent or better based upon the weight of aromatic in the original hydrocarbon feed and usually provides for similar recoveries for the nonaromatic hydrocarbons.

Figure 2:
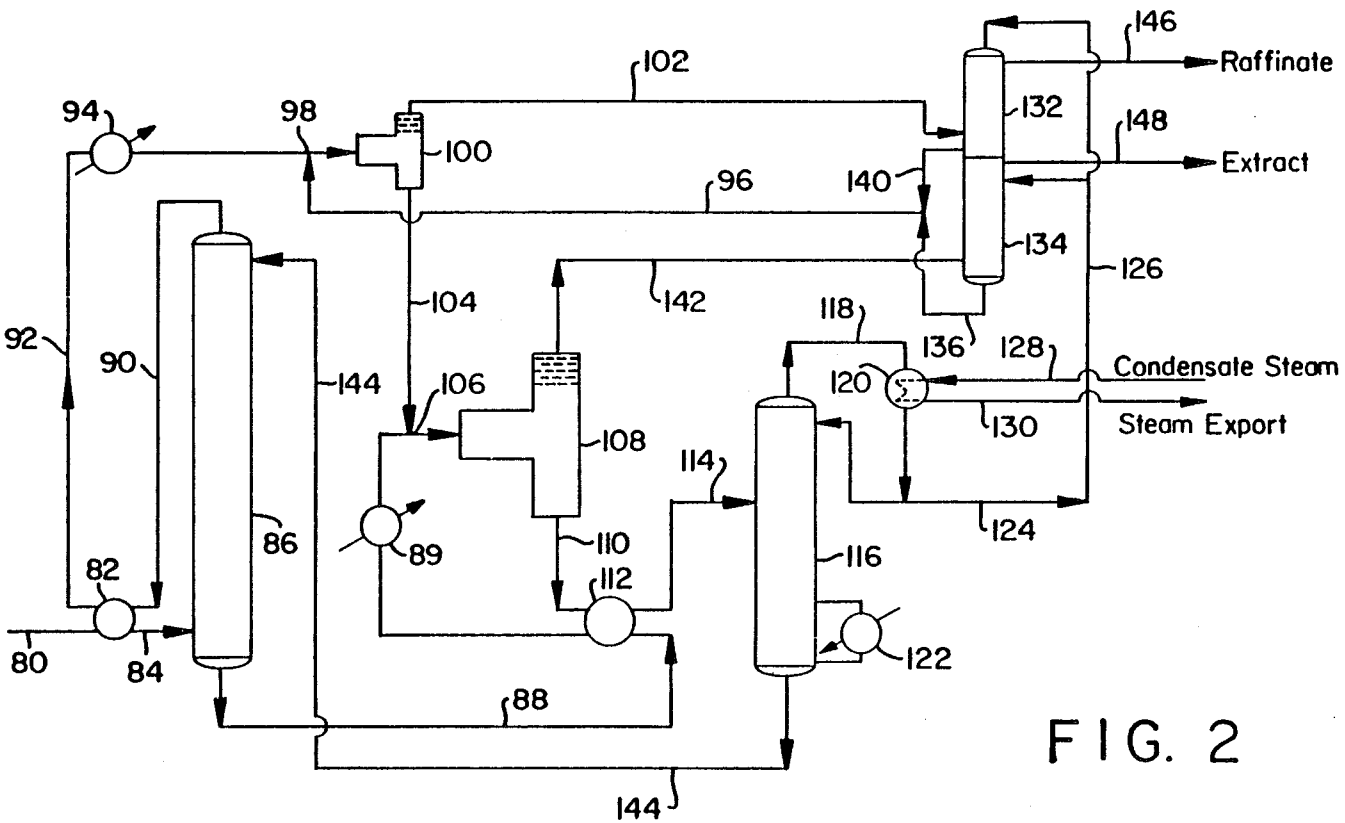
FIG. 2 is a schematic flow diagram of the process of the invention wherein steam export is shown.

The instant process may be carried out in many process schemes according to the aforementioned disclosures and consistent with heretofore generally accepted process design principles. FIG. 1 depicts a flow diagram of the instant process where water is the anit-solvent and steam is employed internally in the process. FIG. 1 does not employ steam export. A process according to this invention involving steam export is depicted in FIG. 2.

Referring to FIG. 1:

The mixed hydrocarbon feed is introduced at 10 at pump 14 and split to lines 12A and 12B. The feed passes through line 12A and heat exchanger 16 and the feed in line 12B heat exchanges with raffinate in heat exchanger 18. At this point the feed in lines 12A and 12B is combined and heated with raffinate from line 26 in heat exchanger 20 before introduction to extraction column 24. Exchangers 16 and 18 are optional when the temperature in extractors 38 and 39 is close to that of the feed in line 12. An extraction solvent, preferably having a temperature in the range of from about 150° C. to about 275° C., most preferably about 200° C. to about 240° C. is introduced near the top of extraction column 24 via line 57 and percolates down column 24 removing aromatics from the hydrocarbon feed forming a raffinate and an aromatic-rich solvent phase. The raffinate, containing primarily non-aromatics and aromatic selective solvent (e.g., about 2 to about 10 wt.%) exits the top of the column 24 via line 26 and heat exchanger 20 where it is cooled with the incoming hydrocarbon feed in line 12. The raffinate phase is further cooled in cooler 33, if necessary, to promote the formation of a raffinate phase and a solvent phase. Recycled aromatic selective solvent and antisolvent from the raffinate (extractor 39) and extract washings (extractor 38), when water is the selected anti-solvent, are combined and introduced via line 44A to decantation tank (zone) 34A. The anti-solvent is preferably added and thoroughly mixed with the raffinate phase prior to decantation tank (zone) 34A to further promote the formation of two phases, e.g., at 46A of the drawing, in the decantation zone, although the anti-solvent may be added directly to decantation tank (zone) 34A if desired. It is understood that decantation (separation) zones 34 and 34A may actually comprise one or more separation stages which may involve one or more separation apparatus and which may be carried in a countercurrent or other suitable manner. It may be advantageous to cool and decant solvent from the incoming raffinate prior to the addition of anti-solvent and the further separation of solvent. Water from the raffinate washings (extractor 39) may be introduced at 46A if desired. This will avoid even minimal contamination of the raffinate phase in line 27 with the extract phase from line 36.

The anti-solvent in the solvent/anti-solvent mixture of line 44A reduces the solubility of the aromatic selective solvent in the raffinate phase to a degree not obtainable by simple cooling the raffinate phase. The antisolvent is present in decantation tank (zone) 34A at a concentration from about 1.0% to about 75.0% by weight and most preferably from about 1.0% to about 50.0% by weight, as above discussed. The presence of the anti-solvent decreases the solubility of the solvent in the raffinate phase such that typically less than about 2% by weight solvent and often less than about 1% by weight solvent leaves decantation tank (zone) 34A via line 27. The raffinate then passes to extractor 39 where it is contacted with water to recover the remaining aromatic selective solvent present in the raffinate so as to form a water phase (containing aromatic selective solvent) and a final raffinate product. A second water extraction takes place in extractor 38 wherein the aromatic-rich extract from decantation zone 34, discussed hereinafter, forms a water-phase (containing aromatic selective solvent) and a final aromatic product. Alternatively, steam in line 54 (from distillation column 52) can be used in exchanger 22 to heat the raffinate phase of line 27 and/or the aromatic-rich extract phase of line 36 prior to the water-wash in extractors 39 and 38 (phantom lines in Figure). This could be especially advantageous when heavy feedstocks are being treated, e.g., bright stock, to reduce the viscosity of the raffinate and extract phases. The water-phases from extractors 38 and 39 contain primarily water and small amounts of aromatic selective solvent that was dissolved or entrained in the aromatic-rich extract and raffinate. The combined water-phases are recycled to decantation tank (zone) 34A via line 44A, as needed, if water is the selected anti-solvent and from decantation tank 34A via line 44 to 46 prior to introduction of the the aromatic-rich extract phase to decantation zone 34.

It should be pointed out that the terms "phase" and "product" are named after their main components, which is present in the phase in an amount of at least 50% by weight and in many cases in an amount of 90% by weight or higher. The aromatic-rich solvent phase, containing primarily aromatic selective solvent and aromatic hydrocarbons, leaves the bottom of extraction column 24 via line 28 and heat exchangers 29 and 30 where it is cooled with aromatic selective solvent in lines 57 and 48, respectively. The aromatic-rich solvent phase is further cooled to promote two phase formation, if necessary, in cooler 32. Recycled aromatic selective solvent and anti-solvent, when water is the selected anti-solvent, are introduced via line 44 to decantation tank (zone) 34. Thus, the solvent contained in line 44 is returned to the process. The anti-solvent is preferably added to the aromatic-rich solvent phase prior to decantation tank (zone) 34 to further promote the formation of two phases, e.g., at 46 of the drawing, in the decantation zone, although anti-solvent may be added directly to decantation tank (zone) 34 if desired. The anti-solvent in the solvent/anti-solvent mixture of line 44 reduces the solubility of the aromatic hydrocarbon in the aromatic selective solvent to a degree not obtainable by simple cooling of the aromatic-rich solvent phase. The anti-solvent present in the decantation tank (zone) 34 is typically at a concentration of from about 0.5% to about 25.0% by weight, based on the weight of aromatics and solvent in decantation tank (zone) 34, preferably from about 0.5% to 15.0% by weight and most preferably from about 5% to about 10.0% by weight. The concentration of the anti-solvent in decantation tank (zone) 34A will be up to about 75 weight percent based on the weight of the raffinate and anti-solvent. The presence of the anti-solvent decreases the solubility of the aromatics and raffinate in the extraction solvent such that typically less than about 2 weight percent aromatics in the solvent or solvent in the raffinate is present and preferably less than about 1 weight percent, leaves decantation tanks 34 and 34A, respectively, via lines 48 and 27, respectively.

The aromatic-rich extract phase of decantation tank (zone) 34 exits via line 36 to water-extraction column 38 where it is contacted with water (preferably water derived from the removal of water from the solvent/anti-solvent mixture when water is the anti-solvent) from the solvent phase of decantation tank (zone) 34. This extraction with water removes entrained and/or dissolved solvent from the aromatic-rich extract phase. Similarly, the raffinate phase of decantation tank 34A exits via line 27 to water-extraction column 39 where it is contacted with water to remove entrained and dissolved solvent from the raffinate phase.

The solvent phase of decantation tank (zone) 34 passes via line 48 through heat exchanger 30 wherein it heat exchanges with hot aromatic-rich solvent of line 28 prior to introduction to distillation column (zone) 52. The solvent/water phase from decantation tank 34A will typically comprise up to about 90 weight percent water (when water is the anti-solvent) and is advantageously employed by introduction at 46 to the aromatic rich solvent prior to or concurrent to its introduction to decantation zone 34. The use of a distillation zone in the instant embodiment at 52 is not intended to be limiting, since any means for decreasing the concentration of the anti-solvent in the aromatic-selective solvent may be employed. The use of a distillation zone is preferred when the anti-solvent is water, since the steam generated therein may be advantageously and economically employed in this and/or other processes (steam export is not shown in FIG. 1).

When water is the selected anti-solvent the solvent phase in line 48 is introduced to distillation zone 52 wherein water is distilled, preferably under pressure when generated steam is to be exported to other processes, and removed as steam via line 54. Steam in line 54 may be heat exchanged at 22 with the mixed hydrocarbon feed, raffinate and/or extract, after which the steam may be condensed by cooler 62, and the water condensate may be employed in extractors 38 and 39. Alternatively, the steam leaving heat exchanger 22 may be advantageously employed in this or other processes (not shown). The aromatic selective solvent leaves distillation zone 52 via line 57, it is heated first in exchanger 29 with hot solvent from line 28 leaving extraction column 24, and finally it is heated to extraction temperature in heater 31 before going into extraction column 24.

As above discussed alternative schemes may be substituted for that above-described for the removal of the anti-solvent, depending on the selection of the anti-solvent. Further, alternative schemes employing steam export to other processes may be employed as applicable to the various designs of manufacturing facilities. The above described scheme is particularly advantageous in terms of the reduction in energy required to carry out the instant process. For example, the above-described extraction-separation process results in a reduction in energy requirements for the dearomatization, as compared to conventional dearomatization processes, by as much as 50 percent to about 80 percent depending on the feed being subjected to dearomatization by use of the process hereunder.

The total anti-solvent, e.g. water, in the system can be easily determined because the amount of water introduced at 46 and 46A to decantation tanks 34 and 34A can be monitored. Allowances will necessarily be made for water losses through leakage, upsets, steam export, if any, and the like so as to maintain the amount of anti-solvent present in decantation tanks 34 and 34A at the desired concentration, as above discussed.

The process described in FIG. 1 was evaluated using a mixed extraction solvent of tetraethylene glycol and methoxytriglycol. The chemical analyses of the contents at selected points in the process, as described in reference to FIG. 1, are set forth in Table I below. Table I shows a material balance for one embodiment of the process at 60° F. using a bright stock feed.

Referring to FIG. 2:

FIG. 2 depicts a process according to the instant invention wherein Steam export is included as a feature of the process embodiment. The mixed hydrocarbon feed is introduced at 80 and passes through heat exchanger 82 where the incoming feed and raffinate in line 90 are heat exchanged to heat the feed and cool the raffinate. The feed is introduced via line 84 to extraction column 86 where the feed is contacted with extraction solvent introduced via line 144 to extraction column 86. The raffinate product exits extraction column 86 via line 90, heat exchanger 82 and passes via line 92 to heat exchanger 94 where the raffinate is cooled, e.g., the raffinate may be heat exchanged with cold water. The cooled raffinate is then introduced to a raffinate decantationn zone. The raffinate is introduced to the decantation zone with an anti-solvent effective in decreasing the solubility of the non-aromatic hydrocarbons of the raffinate in the extraction solvent. The anti-solvent, preferably water, is typically added at a point prior to the decantation zone, e.g., at 98, to allow for thorough mixing with the raffinate to further promote the formation of two phases in decantation zone 100. A raffinate phase containing a higher concentration of non-aromatic hydrocarbons and a lower concentration of extraction solvent than present in line 92 exits decantation zone 100 via line 102. The anti-solvent/solvent phase from decantation tank 100 may be introduced via line 104 at 106 to decantation zone 108. The aromatic-rich extract phase leaves extraction column 86 via line 88 and via heat exchanger 112 and is cooled at 89. Anti-solvent is added to the cooled aromatic-rich solvent phase, preferably at 106 prior to introduction to decantation zone 108, to promote the formation of two phases. As above noted, the anti-solvent introduced at 106 is preferably at least in part derived from the anti-solvent/solvent phase from decantation zone 100. Two phases are formed in decantation zone 108. The aromatic-rich phase exits via line 142 to water-extraction column 134. Similarly, raffinate in line 102 is introduced to water-extraction column 132. The raffinate and aromatic-rich extract are contacted with water to remove entrained and/or dissolved solvent. The raffinate is collected via line 146 and the extract is collected via line 158. Wash water from water extraction columns 132 and 134 may be employed via lines 140 and 136, respectively, combined at 140 as the anti-solvent and introduced via 96 to 98. The solvent-rich phase from decantation zone 108 exits via line 110 and is typically heat exchanged at heat exchanger 112 with the aromatic-rich phase in line 88. The solvent-rich phase is then introduced via line 114 to a distillation zone 116 where water is distilled under pressure and exits via line 118 to 120 where steam is produced from condensate introduced via line 128 for export to other processes (not shown) via line 130. A reboiler 122 may be employed. The solvent-rich phase is then recycled via line 144 to extraction column 86.

TABLE 1

| Stream No. | Compound | Tetra[1] lb/hr | MTG[2] lb/hr | $H_2O$ lb/hr | Raffinate Oil lb/hr | Extract Oil lb/hr | Total lb/hr | Tetra wt. % | MTG wt. % | $H_2O$ wt. % | Raffinate Oil wt. % | Extract Oil wt. % |
|---|---|---|---|---|---|---|---|---|---|---|---|---|
| 10 | Feed | — | — | — | — | — | 93,343 | | | | | |
| 57 | Dry Lean Solvent | 470,273 | 377,129 | 20,066 | — | 8,762 | 876,230 | 53.67 | 43.04 | 2.29 | — | 1.00 |
| 26 | Gross Raffinate[3] | 2,456 | 2,903 | — | 49,344 | 40 | 54,743 | 4.49 | 5.30 | — | 90.14 | .07 |
| 28 | Rich Solvent | 467,817 | 374,226 | 20,066 | — | 52,721 | 914,830 | 51.14 | 40.91 | 2.19 | — | 5.76 |
| 28W | Wet Rich Solvent | 470,433 | 377,530 | 40,810 | — | 52,761 | 941,534 | 49.96 | 40.10 | 4.33 | — | 5.60 |
| 48 | Wet Solvent | 470,273 | 377,129 | 40,810 | — | 8,762 | 896,974 | 52.43 | 42.04 | 4.55 | — | 0.98 |
| 36 | Decanted Extract | 160 | 401 | — | — | 43,999 | 44,560 | 0.36 | 0.90 | — | — | 98.74 |
| 27 | Decanted Raffinate | 85 | 697 | — | 49,344 | — | 50,126 | 0.17 | 1.39 | — | 98.44 | — |
| 16 | Raffinate | — | — | — | 49,344 | — | 49,344 | <50 ppm | <50 ppm | — | 100.00 | — |
| 40 | Extract | — | — | — | — | 43,999 | 43,999 | <50 ppm | <50 ppm | — | — | 100.00 |
| 54A | Wash Water | — | — | 20,744 | — | — | 20,744 | 4 ppm | 37 ppm | 100.00 | — | — |
| 54R | Raffinate Wash Water | — | — | 10,966 | — | — | 10,966 | 4 ppm | 37 ppm | 100.00 | — | — |
| 54E | Extract Wash Water | — | — | 9,778 | — | — | 9,778 | 4 ppm | 37 ppm | 100.00 | — | — |
| 42E | Extract Spent Wash Water | 160 | 401 | 9,778 | — | — | 10,339 | 1.55 | 3.88 | 94.57 | — | — |
| 42R | Raffinate Spent Wash Water | 85 | 697 | 10,966 | — | — | 11,748 | 0.72 | 5.93 | 93.34 | — | — |
| 44A | Combined | 245 | 1,098 | 20,744 | — | — | 22,087 | 1.11 | 4.97 | 93.92 | — | — |
| Wash Water 44 | Injection Water | 2,616 | 3,304 | 20,744 | — | 40 | 26,704 | 9.80 | 12.37 | 77.68 | — | 0.15 |

[1]TETRA: tetraethylene glycol
[2]MTG: methoxytriglycol
[3]Raffinate containing solvent

What is claimed is:

1. A process for the dearomatization of a mixed hydrocarbon feed which comprises the following steps:

(a) contacting said feed in an extraction zone at a temperature of at least about 150° C. with an aromatic extraction solvent to provide a solvent phase containing aromatic hydrocarbons and a raffinate phase containing nonaromatic hydrocarbons, wherein the aromatic extraction solvent comprises a polyalkylene glycol of the formula $$HO—[CHR_1—(CR_2R_3)_n—O—]_mH$$

wherein n is an integer from 1 to 5, m is an integer having a value of 1 or greater and $R_1$, $R_2$ and $R_3$ may each be hydrogen, alkyl, aryl, araalkyl, alkylaryl and mixtures thereof and a glycol ether of the formula $$R_4O—[CHR_5—(CHR_6)_xO]_y—R_7$$

wherein $R_4$, $R_5$, $R_6$ and $R_7$ may each be hydrogen, alkyl, aryl, araalkyl, alkylaryl and mixtures thereof with the proviso that $R_4$ and $R_7$ are not both hydrogen; x is an integer from 1 to 5; and y may be an integer from 2 to 10;

(b) cooling said solvent and raffinate phases;

(c) introducing said cooled solvent phase to a separation zone and introducing therewith an effective amount of an anti-solvent for said aromatic hydrocarbons in said mixed extraction solvent to provide an extract phase containing aromatic hydrocarbons and a solvent phase containing mixed extraction solvent and anti-solvent;

(d) introducing said cooled raffinate phase to a separation zone and introducing therewith an effective amount of an anti-solvent for such aromatic selective solvent in said raffinate phase to provide a raffinate phase and a solvent/anti-solvent phase;

(e) adjusting the anti-solvent in said solvent phase and recycling said solvent phase to the extraction zone of step (a); and (f) recovering the extract phase of step (c) and the raffinate phase of step (d).

2. The process of claim 1 wherein the mixed extraction solvent consists essentially of a polyalkylene glycol selected from the class consisting of diethylene glycol, triethylene glycol, tetraethylene glycol and mixtures thereof and a glycol ether selected from the class consisting of methoxytriglycol, ethoxytriglycol, butoxytriglycol, methoxytetraglycol and ethoxytetraglycol and mixtures thereof wherein the glycol either comprises between about 0.5 and 99 percentage by weight of the mixed extraction solvent.

3. The process of claim 2 wherein the polyalkylene glycol is tetraethylene glycol and the glycol ether is methoxytriglycol.

4. The process of claim 1 wherein the anti-solvent in step (c) is employed in an amount from about 0.5 to about 25.0 percent by weight.

5. The process of claim 4 wherein the anti-solvent in step (c) is employed in an amount from about 0.1 to about 15.0 percent by weight.

6. The process of claim 1 wherein the anti-solvent is water.

7. The process of claim 2 wherein the anti-solvent is water.

8. The process of claim 1 wherein the temperature in the extraction zone is from about 150° C. to about 275° C.

9. The process of claim 1 wherein the temperature in the separation zone is from about 25° C. to about 150° C.

10. The process of claim 8 wherein the temperature in the extraction zone is from about 170° C. to about 250° C.

11. The process of claim 9 wherein the temperature in the separation zone is from about 25° C. to about 100° C.

12. The process of claim 11 wherein the temperature in the separation zone is from about 25° C. to about 70° C.

13. The process of claim 1 wherein the ratio of solvent to feed in the extraction zone of step (a) is in the range of about 5 to about 12 parts by volume of solvent to one part by volume of feed.

14. The process of claim 1 which includes the additional step of separately contacting the raffinate and extract of step (f) with water to form two water phases containing primarily water and extraction solvent; a raffinate phase; and an extract phase.

15. The process of claim 14 which includes the additional step of recovering extraction solvent present in the water phases and recycling said extraction solvent to step (d).

16. The process for the dearomatization of a mixed hydrocarbon feed comprising a lubricating oil fraction which comprises the following steps:

(a) contacting said feed at a temperature of from about 150° C. to about 275° C. in an extraction zone with an extraction solvent to provide an aromatic-rich solvent phase and a raffinate phase;

(b) cooling said aromatic-rich solvent and raffinate phases;

(c) introducing said cooled aromatic-rich solvent phase to a separation zone at a temperature between about 25° C. and about 70° C. in the presence of from about 0.5 to about 25.0 percent by weight water to provide an extract phase containing aromatic hydrocarbons and a solvent-rich phase containing mixed extraction solvent and water;

(d) introducing said cooled raffinate phase to a separation zone in the presence of about 0.5 to about 90.0 percent by weight water as based on the total weight of water and the raffinate phase to provide a raffinate phase containing non-aromatic hydrocarbons and a solvent/water phase;

(e) adjusting the water present in the solvent-rich phase of step (c) and the solvent/water phase of step (d) to an amount between 0.5 wt % and 15.0 wt %;

(f) recycling at least a portion the phases in step (e) to step (a);

(g) separately contacting the raffinate of step (d) and the extract of step (c) with water to form a raffinate product an extract product and two water phases;

(h) combining the water phases of step (g);

(i) recycling at least a portion of the combined water phase of step (h) to step (d); and (j) recovering said extract product and raffinate product of step (g).

17. The process of claim 16 wherein less than about 2 percent by weight solvent is present in the solvent phase of step (c).

18. The process of claim 17 wherein less than about 1 percent by weight aromatic hydrocarbon is present in the raffinate phase of step (d).

19. The process of claim 16 wherein from about 3.0 to about 10.0 weight percent water is employed in step (c) and from about 1.0 to about 80 weight percent water is employed in step (d).

20. The process of claim 19 wherein from about 5.0 to about 10.0 percent by weight water is employed in step (c).

21. The process of claim 16 wherein the temperature in the extraction zone of step (a) is from about 150° C. to about 240° C.

22. The process of claim 16 wherein the temperature in the separation zone is from about 25° C. to about 70° C.

23. The process of claim 16 wherein the ratio of solvent to feed in the extraction zone of step (a) is in the range of about 4 to about 12 parts of weight of solvent to one part by weight of feed.

24. The process of claim 21 wherein the temperature of the extraction zone is from about 200° C. to about 240° C.

25. The process of claim 16 wherein the amount of water in the extraction solvent is between about 0.1 and about 15 percent by weight.

26. The process of claim 17 wherein the solvent is a mixed extraction solvent comprising a polyalkylene glycol of the formula:

$$HO—[CHR_1—(CR_2R_3)_n—O—]_mH$$

wherein n is an integer from 1 to 5, m is an integer from 1 to 10, and $R_1$, $R_2$ and $R_3$ may be each be hydrogen, alkyl, aryl, araalkyl and mixtures thereof; and between about 0.5 and 99 percent by weight based on the total weight of the mixed extraction solvent of a polyalkylene glycol ether of the formula $$R_4O—[CHR_5—(CHR_6)_xO]_y—R_7$$

wherein x is an integer from 1 to 5 and y is an integer from 2 to 10 and wherein $R_4$, $R_5$, $R_6$ and $R_7$ may each be hydrogen, alkyl, aryl, aralkyl, alkyl aryl and mixtures thereof with the priviso that $R_4$ or $R_7$ are not both hydrogen.

27. The process of claim 26 wherein the extraction solvent consisting essentially of a mixture of a polyalkylene glycol selected from the group consisting of triethylene glycol, tetraethylene glycol and mixtures thereof and a glycol ether selected from the group consising of $$R_4O—[CHR_5—(CHR_6)—_xO]_y—R_7$$

wherein x is 1 and y is an integer between about 3 and about 6 and wherein $R_4$, $R_5$, $R_6$ and $R_7$ are hydrogen or alkyl having from 1 to 10 carbon atoms or are hydrogen with the priviso that $R_4$ and $R_7$ are not both hydrogen.

28. The process of claim 27 wherein the mixed extraction solvent comprises: $R_4$ is at least one of methyl, ethyl, propyl or butyl or mixtures thereof; and $R_5$, $R_6$ and $R_7$ are hydrogen; x is 1; and y is 3.

* * * * *